US012600523B2

(12) United States Patent
Urdoi

(10) Patent No.: US 12,600,523 B2
(45) Date of Patent: Apr. 14, 2026

(54) PACKAGING CONTAINER AND FOLDING METHODS FOR PACKAGING CONTAINER

(71) Applicant: Deutsche Post AG, Bonn (DE)

(72) Inventor: Adriana Urdoi, Hoensbroek (NL)

(73) Assignee: Deutsche Post AG, Bonn (DE)

( * ) Notice: Subject to any disclaimer, the term of this patent is extended or adjusted under 35 U.S.C. 154(b) by 0 days.

(21) Appl. No.: 18/700,100

(22) PCT Filed: Oct. 10, 2022

(86) PCT No.: PCT/EP2022/078127

§ 371 (c)(1),
(2) Date: Apr. 10, 2024

(87) PCT Pub. No.: WO2023/066702

PCT Pub. Date: Apr. 27, 2023

(65) Prior Publication Data

US 2024/0417137 A1 Dec. 19, 2024

(30) Foreign Application Priority Data

Oct. 18, 2021 (EP) ..... 21203249

(51) Int. Cl.
*B65D 21/08* (2006.01)
*B65D 30/00* (2006.01)
*B65D 33/25* (2006.01)

(52) U.S. Cl.
CPC ..... *B65D 21/08* (2013.01); *B65D 29/00* (2013.01); *B65D 33/2508* (2013.01); *B65D 2313/02* (2013.01); *B65D 2313/04* (2013.01)

(58) Field of Classification Search
CPC ..... B65D 5/0005; B65D 5/36; B65D 21/08; B65D 29/00; B65D 33/2508;
(Continued)

(56) References Cited

U.S. PATENT DOCUMENTS 3,031,121 A * 4/1962 Chase ..... B65D 81/3858 383/110
3,122,225 A * 2/1964 Ward ..... A45C 7/0063 D3/902

(Continued)

FOREIGN PATENT DOCUMENTS

IT UB20160966 A1 8/2017
WO WO 2020/079195 4/2020

OTHER PUBLICATIONS

International Search Report for corresponding Application No. PCT/EP2022/078127, dated Feb. 17, 2023, 2 pages.

*Primary Examiner* — William L Miller
(74) *Attorney, Agent, or Firm* — Dority & Manning, P.A.

(57) ABSTRACT

A packaging container for shipping goods is configured for conversion from a shelf configuration into a first packaging configuration by a first folding method, and from the shelf configuration into a second packaging configuration by a second folding method, wherein in the shelf configuration the packaging container is collapsible such that two opposite faces of the packaging container come in direct con-tact with each other, wherein in the first and second packaging configuration the packaging container is configured such that two opposite faces of the packaging container are attached to each other by a dimensionally stable sidepiece, and wherein a volume enclosed by the packaging container in the first packaging configuration is different from a volume enclosed by the packaging container in the second packaging configuration.

10 Claims, 5 Drawing Sheets

Figure 1A:
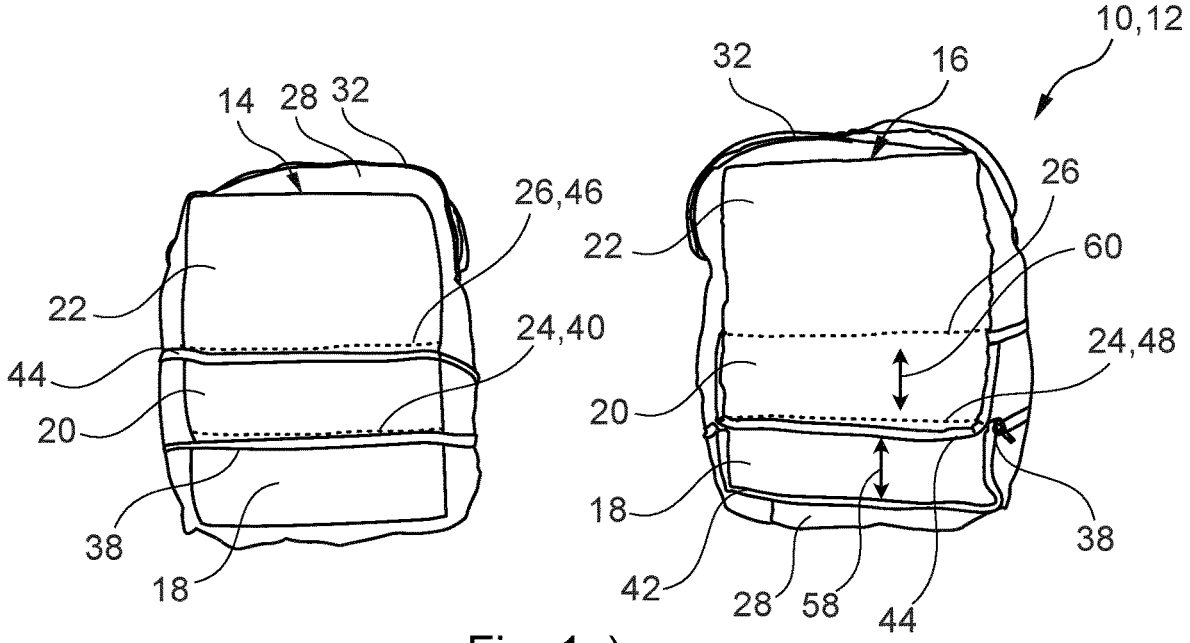

(58) Field of Classification Search
CPC ..... B65D 2313/02; B65D 2313/04; A45C 7/0077; A45C 7/0063; Y02W 30/80
See application file for complete search history.

(56) References Cited

U.S. PATENT DOCUMENTS 5,213,418 A * 5/1993 Dancy ..... A45C 7/0077 383/121.1
5,399,020 A * 3/1995 Cheng ..... A45C 7/0077 383/127
5,472,279 A * 12/1995 Lin ..... A45C 11/20 383/110
5,490,396 A * 2/1996 Morris ..... F25D 3/08 383/110
5,896,962 A * 4/1999 Smith ..... A45C 13/02 190/110
6,015,072 A * 1/2000 Young ..... A45C 7/0063 383/111
6,068,402 A 5/2000 Freese et al.
6,336,577 B1 * 1/2002 Harris ..... A45F 3/04 383/110
7,682,080 B2 * 3/2010 Mogil ..... B60R 5/04 383/110
11,666,179 B2 * 6/2023 Mogil ..... A47J 41/0044 62/457.2
2007/0235352 A1 10/2007 Madson
2010/0270317 A1 * 10/2010 Kieling ..... B65D 81/3895 220/592.25
2010/0327048 A1 12/2010 Tsai
2012/0267365 A1 * 10/2012 Sabounjian ..... A45C 7/0077 29/401.1
2013/0087423 A1 * 4/2013 Bettua ..... A45C 7/0077 190/105
2014/0117072 A1 * 5/2014 Cullen ..... B65D 25/2873 229/117.05
2015/0344170 A1 * 12/2015 Schneider ..... B65D 43/14 220/4.28
2016/0206061 A1 * 7/2016 Ford ..... A45C 9/00
2019/0223571 A1 7/2019 Chan et al.
2020/0172318 A1 * 6/2020 Dong ..... B65D 81/3897
2021/0361043 A1 * 11/2021 Wood ..... A45C 7/0077
2024/0367861 A1 * 11/2024 Greenfield ..... A45C 13/008
2025/0057293 A1 * 2/2025 Burnsed, Jr. ..... A45C 13/30

* cited by examiner

PACKAGING CONTAINER AND FOLDING METHODS FOR PACKAGING CONTAINER

CROSS-REFERENCE TO RELATED APPLICATIONS

This application is the U.S. National Stage entry of International Application No. PCT/EP2022/078127, filed on Oct. 10, 2022, which, in turn, claims priority to EP patent application Ser. No. 21/203,249.4, filed on Oct. 18, 2021, both of which are hereby incorporated herein by reference in their entireties for all purposes.

FIELD OF THE INVENTION

The invention relates to a packaging container for shipping goods, wherein the packaging container is configured for conversion from a shelf configuration into a first packaging configuration by a first folding method, and from the shelf configuration into a second packaging configuration by a second folding method.

Furthermore, the invention relates to a folding method for folding a packaging container from a shelf configuration into a first packaging configuration.

Further, the invention relates to a folding method for folding a packaging container from a shelf configuration into a second packaging configuration.

BACKGROUND OF THE INVENTION

With electronic commerce the amount of goods delivered in packaging containers has steadily increased. This increase has also potential negative effects on the environment. A potential problem of existing packaging containers is that the packaging containers are typically designed to be single use. After being opened the packaging containers are discarded which creates unnecessary waste.

In order to provide sustainable packaging solutions for shipping goods, one possibility is to provide packaging containers that are reusable, such that the packaging container can be used for multiple trips.

The document WO 2020/079195 A1 describes a reusable and returnable mailing bag. It is made of a flexible reusable container forming a cavity having an opening with a reusable closure with a tamper-evident seal wherein the container has a first configuration for receiving goods for transit to or from a customer and a second compact configuration for the customer to return the container, wherein the container has one or more retention features to secure the container in the second configuration.

Even though mailing bags made of flexible materials-which are also called flyers—have the advantage that they can be used with goods having different shapes, they may cause problems in the shipping process. One potential problem is that the mailing bags may crumple. Crumpling not only affects the safety of the packaged goods, but also the logistical process. The crumpling may hinder a scanner to scan a label of the mailing bag or even lead to the situation that the mailing bag gets stuck in a conveyor used for sorting. Furthermore, the flexible mailing bags do not allow for volumetric weighting in order to determine the shipping cost.

On the other hand, when using boxes as packaging containers, more protection is provided to the packaged goods. Furthermore, boxes allow for volumetric weighting. However, boxes have a predetermined size and cannot be adapted to the shape of the delivered good. Thus, a crucial aspect of sustainable packaging solutions i.e. that the packaging container should satisfy different packaging needs, cannot be met by boxes. This leads to the situation that different sizes of boxes are hold available in storage making storage management complicated.

US 2007/235352 A1 describes a receptacle that is foldable between its open mode for receiving material and a secured mode where its top is double folded and secured with fasteners for maintaining material within the receptacle, or the receptacle is foldable between its open mode and a storage mode when the receptacle is folded to align releasable fasteners and to create a pass-through pocket for receiving accessories. In the storage mode, the receptacle can easily be carried in a pocket or purse until needed to receive undesirable material for disposal. The receptacle can be unfolded from the storage mode to the open mode to receive material.

US 2010/327048 A1 relates to a packaging container that includes a body plate defined into front and back faces by a first folding line. The front face includes second and third folding lines. The second and third folding lines define two connection portions. The body plate further includes an enclosing plate. A fourth folding line is located between the front face and the enclosing plate. The back face is folded upwards along the first folding line, the connection portions are folded inwards along the second and third folding lines. The connection portions are stuck to the back face. A first pre-folding line and a second pre-folding line are located between the second and third folding lines. A fifth pre-folding line and a sixth pre-folding line are located on the back face. Two seventh pre-folding lines and two eighth pre-folding lines are defined.

DESCRIPTION OF THE INVENTION

Proceeding from this situation, it is an object of the invention to provide a packaging container that satisfy different packaging needs, and is less problematic in the shipping process.

The object is achieved by the features of the independent claims. Advantageous embodiments are specified in the dependent claims.

Accordingly, the object is achieved by a packaging container for shipping goods, wherein the packaging container is configured for conversion from a shelf configuration into a first packaging configuration by a first folding method, and from the shelf configuration into a second packaging configuration by a second folding method, wherein in the shelf configuration the packaging container is collapsible such that two opposite faces of the packaging container in the shelf configuration come in direct contact with each other, wherein in the first and second packaging configuration the packaging container is configured such that two opposite faces of the packaging container in the first or second packaging configuration are attached to each other by a dimensionally stable sidepiece, and wherein a volume enclosed by the packaging container in the first packaging configuration is different from a volume enclosed by the packaging container in the second packaging configuration, and wherein in the first packaging configuration the dimensionally stable sidepiece is formed by first outer face parts of the two opposite faces of the packaging container in the shelf configuration and/or wherein in the second packaging configuration the dimensionally stable sidepiece is formed by first outer face parts and middle face parts of the two opposite faces of the packaging container in the shelf configuration.

An aspect of the packaging container is that it is configured to be folded from the shelf configuration into two different packaging configurations, wherein the volumes enclosed by the packaging container in the two packaging configurations are different from each other. Preferably the volume enclosed by the packaging container in the first packaging configuration is higher than the volume enclosed by the packaging container in the second packaging configuration. Due to the two different volumes enclosed by the packaging container in the first and second packaging configuration, the packaging container suits different packaging needs and can be used for goods having different shapes.

Furthermore, in the shelf configuration the packaging container is collapsible, meaning that in the shelf configuration the two opposite faces of the packaging container can be brought into direct contact to each other. Preferably, in a situation where the two opposite faces are in direct contact to each other, the packaging container is flat. Thus, in the shelf configuration the packaging container can be stored easily by stacking several packaging containers that are in the shelf configuration and collapsed on top of each other. Thus, space-saving storage of the packaging container can be achieved.

A further aspect of the packaging container is, that in the first and second packaging configuration the packaging container is configured such that the two opposite faces of the packaging container are attached to each other by the dimensionally stable sidepiece. Preferably in the first and/or second packaging configuration the packaging container is non-collapsible. Thus, in contrast to mailing bags, that are entirely made of flexible material, the packaging container allows for volumetric weighing. Hence, the shipping process is simplified and the risk of crumpling or getting stuck in a conveyer during shipping is strongly reduced. Furthermore, the dimensionally stable sidepiece ensures a higher protection to the packaged good.

A further aspect of the packaging container is that the packaging container needs to be folded in order to change the configuration of the packaging container from the shelf configuration to the first packaging configuration and/or in order to change the configuration of the packaging container from the shelf configuration to the second packaging configuration. While mailing bags made out entirely of flexible material can adapted their shape by just bending the flexible material at any specific point, the present packaging container can be folded along predefined folding edges. In other words, being configured for conversion from the shelf configuration into the first and/or second packaging configuration means that the packaging container comprises folding edges that allow to fold dimensionally stable parts of the packaging container along the folding edges. Preferably, the edges where the dimensionally stable sidepiece is attached to the two opposite faces of the packaging container in the first and/or second packaging configuration are folding edges of the packaging container.

Furthermore, in the first packaging configuration the dimensionally stable sidepiece is formed by the first outer face parts of the two opposite faces of the packaging container in the shelf configuration and/or in the second packaging configuration the dimensionally stable sidepiece is formed by first outer face parts and middle face parts of the two opposite faces of the packaging container in the shelf configuration.

In other words, the packaging container combines the advantages of a mailing bag made of a flexible material, since the packaging container is adaptable in size and in the shelf configuration the packaging container is collapsible, with the advantage of a box since in the first and/or second packaging configuration the packaging container allows for volumetric weighing, is more robust, and reduces problems in shipping.

In the first and second packaging configuration the packaging container is configured such that the two opposite faces of the packaging container are attached to each other by the dimensionally stable sidepiece. Preferably the dimensionally stable sidepiece forms a planar face of the packaging container in the first and/or second packaging configuration. Further preferably in the first and/or second packaging configuration the packaging container has essentially a cuboidal shape, wherein the two opposite faces are essentially parallel to each other and/or the dimensionally stable sidepiece essentially includes a right angel with each of the two faces. Essentially having a cuboidal shape preferably means in the context of the invention that deviations from the parallelism of the two opposite faces of +40 degrees are possible, and/or deviations from the right angle between the dimensionally stable sidepiece and the two opposite faces of +20 degrees are possible. Furthermore, having essentially a cuboidal shape preferably also means that not all of the six faces of the packaging container need to be planar. Preferably in the first and/or second packaging configuration at least one of the six faces of the of the packaging container is planar, more preferably at least two of the six faces of the of the packaging container are planar, even more preferably three of the six faces of the of the packaging container are planar. This allows for a high protection of the packaged good by the planar faces of the packaging container in the first and/or second packaging configuration and still allows, that the packaging container is adaptable in size and is collapsible in the shelf configuration.

According to a preferred embodiment of the invention the packaging container is configured such that in the first packaging configuration and in the second packaging configuration an extent of the packaging container only differs along one dimension. As already mentioned, the volume enclosed by the packaging container in the first packaging configuration differs from the volume enclosed by the packaging container in the second packaging configuration. Furthermore, the two preferably cuboidal shapes of the packaging container in the two packaging configurations preferably differ only along one dimension. In other words, preferably two of the three dimensions describing a cuboid—i.e. length, width, and height—are equal for the packaging container in the first packaging configuration and for the packaging container in the second packaging configuration. Further preferably the volume difference between the packaging container in the first packaging configuration and the packaging container in the second packaging configuration is proportional to a difference of the extent of the packaging container along one dimension.

According to another preferred embodiment of the invention, each of the two opposite faces of the packaging container in the shelf configuration comprises a dimensionally stable first outer face part, a dimensionally stable middle face part, and a dimensionally stable second outer face part, joint to each other by flexible joints. Preferably, the two opposite faces of the packaging container in the shelf configuration, i.e. the faces that can come in direct contact with each other, each consists of three face parts, i.e. the first outer face part, the middle face part, and the second outer face part, wherein the three face parts are attached to each other by the flexible joints. Further preferably the flexible joints form the folding edges of the packaging container for folding the packaging container from the shelf configuration into the first and/or second packaging configuration.

The first outer face part, the middle face part and the second outer face part are preferably dimensionally stable. Further preferably the first outer face part, the middle face part and/or the second outer face part comprise a non-flexible and/or hard material, such as cardboard. Preferably, the first outer face part, the middle face part and/or the second outer face part have a rectangular form. Further preferably, the first outer face part and/or the second outer face part is joint to the middle face part. Further preferably, the middle face part is joint to the first outer face part and the second outer face part. Even more preferably the first outer face part is joint to the middle face part at a first edge of the middle face part and the second outer face part is joint to the middle face part at a second edge of the middle face part, wherein the first edge and the second edge of the middle face part are parallel to each other. Further preferably the form of the joint first outer face part, middle face part and second outer face part together—i.e. preferably the form of the faces of the packaging container in the shelf configuration—is rectangular.

According to another preferred embodiment of the invention, in the shelf configuration the two opposite faces are circumferentially attached to each other by a flexible sidewall. This has the advantage that the packaging container is collapsible in the shelf configuration. During collapsing the flexible sidewalls bends and ensures that the two opposite faces, which preferably each comprise the dimensionally stable first outer face part, the dimensionally stable middle face part, and the dimensionally stable second outer face part come in direct contact to each other. When collapsed, the packaging container is flat. The flexible sidewall is preferably made of a flexible material.

As already mentioned, the first outer face part, the middle face part and/or the second outer face part preferably comprise a non-flexible and/or hard material, while the flexible sidewall preferably comprises a flexible material. Further preferably the flexible joints between the first outer face part, the middle face part and/or the second outer face part, which preferably form the folding edges of the packaging container also comprises a flexible material. For example, the two opposite faces and the flexible sidewall of the packaging container in the shelf configuration can all be made of the flexible material, while the non-flexible material is used as reinforcement on the two opposite faces to form the first outer face part, the middle face part and/or the second outer face part. Thus, the flexible material of the two opposite faces in between the reinforced parts forms the flexible joints.

According to another preferred embodiment of the invention the flexible material is preferably a durable, penetration resistant, impact resistant, abrasion resistant, cut resistant, lightweight and/or water-resistant packaging material. For example, the flexible material may be a fabric comprising polypropylene, polystyrene, polyester, fiberglass, carbon fiber, para-aramid synthetic fiber composite and/or Kevlar. For example, as flexible material the material known under the trademark Paua from Paua Trading Limited can be used.

As already mentioned, preferably in the first and/or second packaging configuration, the packaging container has essentially a cuboidal shape. To this regard and according to a preferred embodiment of the invention, the packaging container is configured such that in the first and/or second packaging configuration the packaging container comprises three dimensionally stable faces. The dimensionally stable faces preferably comprise a non-flexible and/or hard material, such as cardboard. More preferably in the first and/or second packaging configuration, the packaging container is configured such that three faces of the packaging container comprise dimensionally stable material. Further preferably, the three dimensionally stable faces are the two opposite faces of the packaging container and the dimensionally stable sidepiece. The three dimensionally stable faces have the advantage to give the goods in the packaging container extra protection. Furthermore, they make the packaging container easy to process during shipping, since the risk of crumpling is diminished. Furthermore, the risk that the packaging container gets stuck in a conveyer is reduced, since the dimensionally stable faces provide a smooth surface on which the packaging container can glide through the sorting process. Furthermore, the cuboidal shape ensures that volumetric weighting can be applied to the packaging container.

According to another preferred embodiment of the invention, in the first packaging configuration and/or in the second packaging configuration the two opposite faces are at least in part attached to each other by a flexible sidewall. As already mentioned in the first and second packaging configuration the two opposite faces are attached to each other by the dimensionally stable sidepiece. Furthermore, the two opposite faces are at least in part attached to each other by the flexible sidewall. In other words, in the first and/or second packaging configuration some of the faces of the packaging container, are made of a flexible material and others of the faces are made of the dimensionally stable material.

Further preferably the in the shelf configuration, in the first packaging configuration and/or in the second packaging configuration the two opposite faces are rectangular. In the shelf configuration preferably all four sides of the rectangular faces are attached to each other by the flexible sidewall. In the first and/or second packaging configuration preferably three of the four sides of the rectangular opposite faces are attached to each other by the flexible sidewall.

According to another preferred embodiment of the invention, a form of the first outer face part and a form of the middle face part are congruent to each other and/or a form of the first outer face part and a form of the middle face part are such that a joint form of the first outer face part and the middle face part joint to each other by the flexible joint is congruent to a form of the second outer face part. Furthermore, preferably a width of the flexible sidewall corresponds to a width of the first outer face part and/or the middle face part. These features ensure that the packaging container is easily foldable from the shelf configuration to the first packaging configuration and/or from the shelf configuration to the second packaging configuration. Furthermore, since the form of the first outer face part and the form of the middle face part are such that the joint form of the first outer face part and the middle face part joint to each other by the flexible joint is congruent to the form of the second outer face part, the packaging container in the shelf configuration, when being in the collapsed state such that the two opposite faces are in direct contact to each other, can preferably be folded along a common edge between the second outer face part and the middle face part into a second shelf configuration. In the second shelf configuration the packaging container is preferably flat and comprises a smaller base area.

As already mentioned, in the shelf configuration each of the two opposite faces of the packaging container in the shelf configuration comprises the dimensionally stable first outer face part, the dimensionally stable middle face part, and the dimensionally stable second outer face part, joint to each other by flexible joints. Preferably the packaging container is transformed into the first and/or second packaging configuration by folding the dimensionally stable first outer face part, middle face part and/or second outer face part along the folding edges defined by the flexible joints, thereby generating the packaging container in the first and/or second packaging configuration. In the first as well as in the second packaging configuration the packaging container comprises two faces opposite to each other. In this context and according to another preferred embodiment of the invention, in the first packaging configuration the two opposite faces each comprise two dimensionally stable face parts joint to each other by the flexible joint and/or in the second packaging configuration the two opposite faces each comprises one dimensionally stable face part.

Preferably, in the first packaging configuration the two opposite faces are formed by the second outer face parts and the middle face parts of the two opposite faces of the packaging container in the shelf configuration. Further preferably in first packaging configuration a form of the first face part of the two face parts is congruent to the form of the dimensionally stable sidepiece. This ensures an easy folding of the packaging container. In this context and further preferably, in the second packaging configuration the two opposite faces are formed by the second outer face parts of the two opposite faces of the packaging container in the shelf configuration.

According to another preferred embodiment of the invention the packaging container in the first and/or second packaging configuration is waterproof and/or splash water protected, and/or the packaging container is reusable and/or the packaging container comprises an opening with a reusable closure. This has the advantage that the goods transported by the packaging container are protected from water. Furthermore, the packaging container can be opened and closes multiple times and thus ensures that it is reusable and environmentally friendly. Hence, unnecessary waste can be reduced.

With regard to the opening, preferably the flexible sidewall comprises the opening. Further preferably the opening and/or the reusable closure is arranged such that it extends parallel to edges of the two opposite faces of the packaging container. Further preferably the reusable closure is a zipper, waterproof and/or splash water protected.

According to another preferred embodiment of the invention, the packaging container comprises at least one fastening device configured for fastening the packaging container in the first packaging configuration and/or in the second packaging configuration. Preferably, the packaging container comprises a first fastening device for fastening the packaging container in the first packaging configuration and a second fastening device for fastening the packaging container in the second packaging configuration. The fastening device has the advantage that the packaging container in the first and/or second packaging configuration is hindered to autonomously unfold into the shelf configuration. Preferably the fastening device is reusable, waterproof and/or splash water protected.

Preferably, when folding the packaging container from the shelf configuration into the second packaging configuration, the first fastening device for fastening the packaging container in the first packaging configuration is folded inside. Further preferably, when the packaging container is folded and fastened in the second packaging configuration the first fastening device is neither visible on the outer side nor visible on the inner side of the packaging container.

As already mentioned, each of the two opposite faces of the packaging container in the shelf configuration comprises the dimensionally stable first outer face part, the dimensionally stable middle face part, and the dimensionally stable second outer face part, joint to each other by the flexible joints. In this context and according to another preferred embodiment of the invention, the first fastening device is at least configured to fasten a common edge of the first outer face part and the middle face part of a first face of the two opposite faces to an outer edge of the first outer face part of a second face of the two opposite faces. In other words and preferably, the common edge of the first outer face part and the middle face part of one of the two opposite faces, i.e. the flexible joint which also acts as folding edge along which the first outer face part and/or middle face part can be folded, is fastened to the outer edge of the first outer face part of the opposite face.

In addition or alternatively and according to another preferred embodiment of the invention, the second fastening device is at least configured to fasten a common edge of the middle face part and the second outer face part of a first face of the two opposite faces to a common edge of the first outer face part and the middle face part of a second face of the two opposite faces. In other words and preferably, the common edge of the middle face part and the second outer face part of one of the two opposite faces, i.e. the flexible joint which also acts as folding edge along which the middle face part and/or the second outer face part can be folded, is fastened to the common edge of the first outer face part and the middle face part—i.e. the flexible joint which also acts as folding edge along which the first outer face part and/or the middle face part can be folded—of the opposite face.

Different fastening devices can be used. Preferably the fastening device is a reusable fastening device. According to another preferred embodiment of the invention the fastening device is a zipper, a magnetic fastening device, a hook-and-eye closure, a hook-and-loop fastener, and/or a snap fastener.

Preferably the fastening device is a zipper. More preferably, a first zipper is at least placed along the common edge of the first outer face part and the middle face part of the first face of the two opposite faces and along the outer edge of the first outer face part of the second face of the two opposite faces. Further preferably a second zipper is at least placed along the common edge of the second outer face part and the middle face part of the first face of the two opposite faces and the common edge of the first outer face part and the middle face part of the second face of the two opposite faces. This configuration has the advantage that smooth surfaces of the packaging container in the first and/or second packaging configuration are provided. Thus, friction of the packaging container in the shipping process is reduced.

According to the above and according to another preferred embodiment of the invention, in the first packaging configuration one of the two opposite faces of the packaging container is free of a fastening device within an area of the one face of the packaging container. When using a zipper as fastening device, preferably in the first packaging configuration only one of the four edges of one of the two opposite faces comprises a zipper, while two of the four edges partially comprise a zipper, and one of the four edges is free of a zipper. Hence, since the fastening device is arranged along the edges of one of the two opposite face, the area within the one face of the packaging container is free of a fastening device.

According to another preferred embodiment of the invention, in the second packaging configuration both opposite faces of the packaging container are free of a fastening device within an area of the faces of the packaging container. Preferably, when using a zipper as fastening device, in the second packaging configuration all edges of one of the two opposite faces are completely free of a fastening device and/or in the second packaging configuration only one of the four edges of one of the two opposite faces comprises a zipper, while the other three edges are free of a zipper. Hence, since on one face the fastening device is arranged along the edge of the one face, the area within the one face of the packaging container is free of a fastening device, while the opposite face does not comprise a fastening device along an edge and/or within the are of the face.

By providing faces and/or edges of the packaging container, which are free of the fastening device, the risk that the packaging container gets stuck on a conveyor or jams the sorting process is reduced.

In summary the packaging container satisfy different packaging needs by being configured to be folded into two different packaging configurations, wherein due to the dimensionally stable sidepiece attached to the two opposite faces of the packaging container in the first and/or second packaging configuration, the packaging container provides more protection to the packaged good and is less problematic in the shipping process. Further features and advantages of the packaging container are directly and unambiguously derived by the person skilled in the art from the description of a first folding method and a second folding method.

As already mentioned, the invention also relates to a first folding method for folding the packaging container from the shelf configuration into the first packaging configuration.

Accordingly, the object is achieved by the folding method for folding the packaging container from the shelf configuration into the first packaging configuration, wherein the packaging container is configured for conversion from the shelf configuration into the first packaging configuration by the folding method, and from the shelf configuration into a second packaging configuration by another folding method, wherein in the first and second packaging configuration the packaging container is configured such that two opposite faces of the packaging container in the first or second packaging configuration are attached to each other by a dimensionally stable sidepiece, wherein a volume enclosed by the packaging container in the first packaging configuration is different from a volume enclosed by the packaging container in the second packaging configuration, comprising the steps of providing the packaging container in the shelf configuration, wherein in the shelf configuration the packaging container is collapsed such that a lower face and an upper face of two opposite faces of the packaging container in the shelf configuration come in direct contact with each other, and wherein the lower and the upper faces each comprise a dimensionally stable first outer face part, a dimensionally stable middle face part, and a dimensionally stable second outer face part, joint to each other by flexible joints, forming a dimensionally stable sidepiece by folding the first outer face part of the upper face towards the lower face, and folding the first outer face part of the lower face over the folded first outer face part of the upper face, such that the first outer face part of the upper face and the first outer face part of the lower face coincide, such that the dimensionally stable sidepiece of the packaging container in the first packaging configuration is formed by the first outer face parts of the two opposite faces of the packaging container in the shelf configuration.

Preferably, when folding the first outer face part of the upper face towards the lower face, by folding the first outer face part of the upper face downwards along the common edge of the first outer face part and the middle face part, a preform of the stable sidepiece between a first face of the packaging container and a second face of the packaging container in the first packaging configuration is created. By folding the first outer face part of the lower face upwards over the folded first outer face part of the upper face, this preform is reinforced and the dimensionally stable sidepiece of the packaging container in the first packaging configuration is formed.

Furthermore, preferably in the shelf configuration, the two opposite faces are rectangular and are circumferentially attached to each other by a flexible sidewall. The flexible sidewall has the advantage that when folding the first outer face part of the lower face downwards, the flexible sidewall, is folded over the first outer face part of the lower face. Furthermore, when folding the first outer face part of the lower face upwards over the downwards folded first outer face part of the upper face, the inwards folded flexible sidewall ends up in between the first outer face part of the upper face and the first outer face part of the lower face.

Further preferably, the method comprises the step of closing a first fastening device, wherein the first fastening device is configured for fastening the packaging container in the first packaging configuration. By closing the first fastening device, preferably a zipper, the packaging container is fastened in the first packaging configuration. Preferably in the first packaging configuration, the first fastening device extends along three edges of the dimensionally stable sidepiece.

As already mentioned, the invention also relates to a second folding method for folding the packaging container from the shelf configuration into the second packaging configuration.

Accordingly, the object is achieved by the folding method for folding the packaging container from the shelf configuration into the second packaging configuration, wherein the packaging container is configured for conversion from the shelf configuration into the second packaging configuration by the folding method, and from the shelf configuration into a first packaging configuration by another folding method, wherein in the first and second packaging configuration the packaging container is configured such that two opposite faces of the packaging container in the first or second packaging configuration are attached to each other by a dimensionally stable sidepiece, wherein a volume enclosed by the packaging container in the first packaging configuration is different from a volume enclosed by the packaging container in the second packaging configuration, comprising the steps of providing the packaging container in the shelf configuration, wherein in the shelf configuration the packaging container is collapsed such that a lower face and an upper face of two opposite faces of the packaging container in the shelf configuration come in direct contact with each other, and wherein the lower and the upper faces each comprise a dimensionally stable first outer face part, a dimensionally stable middle face part, and a dimensionally stable second outer face part, joint to each other by flexible joints, forming a dimensionally stable sidepiece by bringing the first outer face part of the upper face into direct contact with the middle face part of the lower face such that the outer face part and the middle face part coincide, and folding the first outer face part of the lower face over the first outer face part of the upper face, such that the first outer face part of the lower face coincides with the first outer face part of the upper face, and folding the first outer face part of the lower face, the first outer face part of the upper face, and the middle face part of the lower face together towards the middle face part of the upper face, such that the dimensionally stable sidepiece of the packaging container in the second packaging configuration is formed by the first outer face parts and the middle face parts of the two opposite faces of the packaging container in the shelf configuration.

Preferably the step of bringing the first outer face part of the upper face into direct contact with the middle face part of the lower face such that the outer face part and the middle face part coincide, comprise bringing the first outer face part of the upper face into direct contact with the middle face part of the lower face such that the middle face part of the upper face is folded downwards and the first outer face part of the lower face is folded upwards.

Furthermore, preferably in the shelf configuration, the two opposite faces are rectangular and are circumferentially attached to each other by the flexible sidewall. The flexible sidewall has the advantage that when bringing the first outer face part of the upper face into direct contact with the middle face part of the lower face such that the outer face part and the middle face part coincide, the flexible sidewall is folded over the first outer face part of the lower face.

Further preferably, the step of folding the first outer face part of the lower face over the first outer face part of the upper face, such that the first outer face part of the lower face coincides with the first outer face part of the upper face, comprises folding the first outer face part of the lower face over the first outer face part of the upper face, such that an inward folded flexible sidewall is in between the first outer face part of the upper face and the downwards folded first outer face part of the lower face.

Further preferably the step of folding the first outer face part of the lower face, the first outer face part of the upper face, and the middle face part of the lower face together towards a middle face part of the upper face, comprises folding the first outer face part of the lower face, the inward folded flexible sidewall, the first outer face part of the upper face, and the middle face part of the lower face together towards the middle face part of the upper face.

Further preferably the method comprises the step of closing a second fastening device, wherein the second fastening device is configured for fastening the packaging container in the second packaging configuration. By closing the second fastening device, preferably a zipper, the packaging container is fastened in the second packaging configuration.

Preferably, in the second packaging configuration, the second fastening device extends along three edges of the dimensionally stable sidepiece. Further preferably, when folding the packaging container from the shelf configuration into the second packaging configuration, the fastening device for fastening the packaging container in the first packaging configuration—i.e. the first fastening device—is folded inside and is not visible anymore, when the packaging container is folded and fastened in the second packaging configuration. Thus, in the second packaging configuration no friction can be provided by the first fastening device and processing of the packaging container during shipping is simplified.

Further features and advantages of the first and/or second method are directly and unambiguously derived by the person skilled in the art from the packaging container as described before.

SHORT DESCRIPTION OF THE DRAWINGS

The invention will be explained in more detail below with reference to the attached drawings by way of preferred embodiments.

Figure 1B:
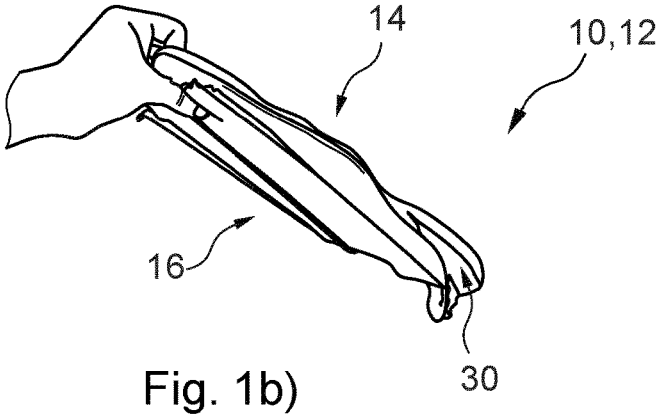
Figure 1C:
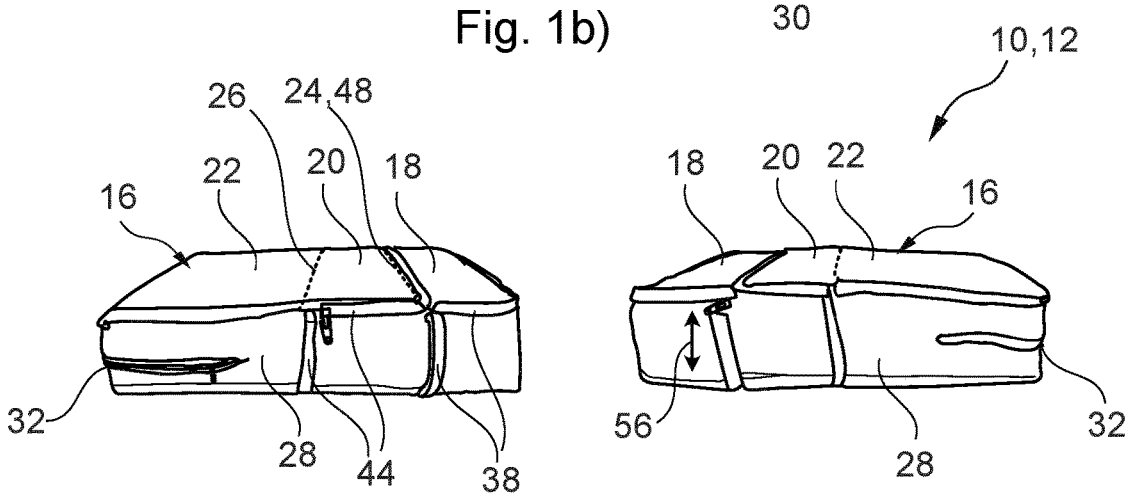
Figure 2A:
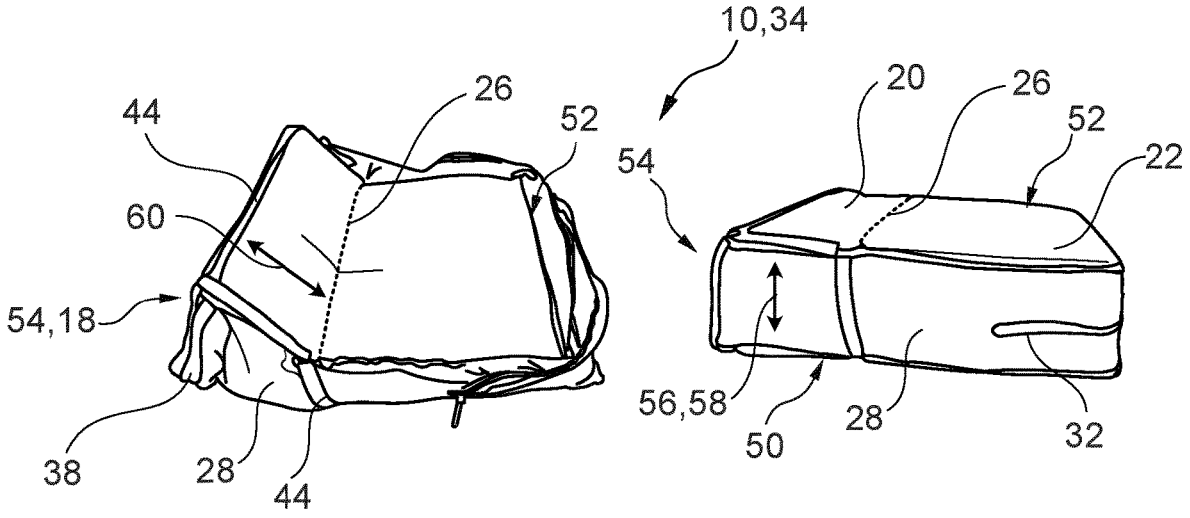
Figure 2B:
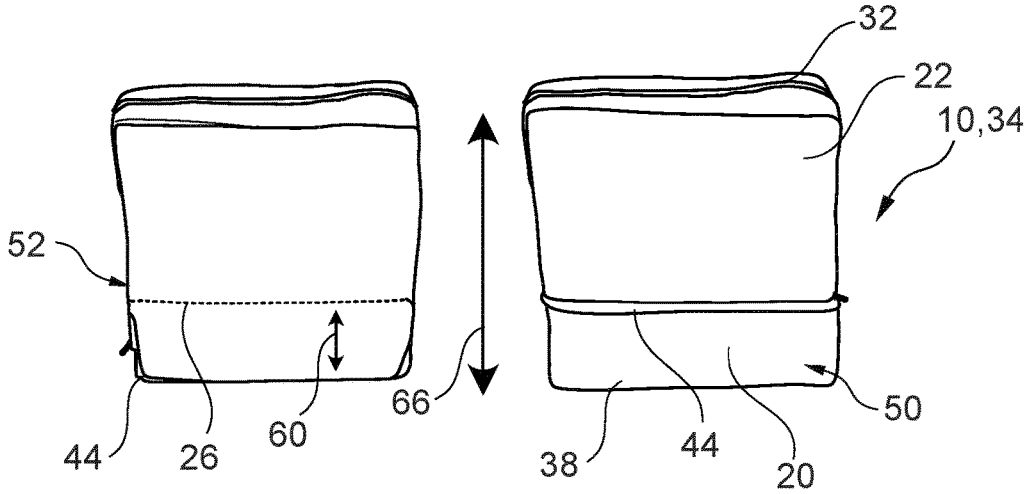
Figure 2C:
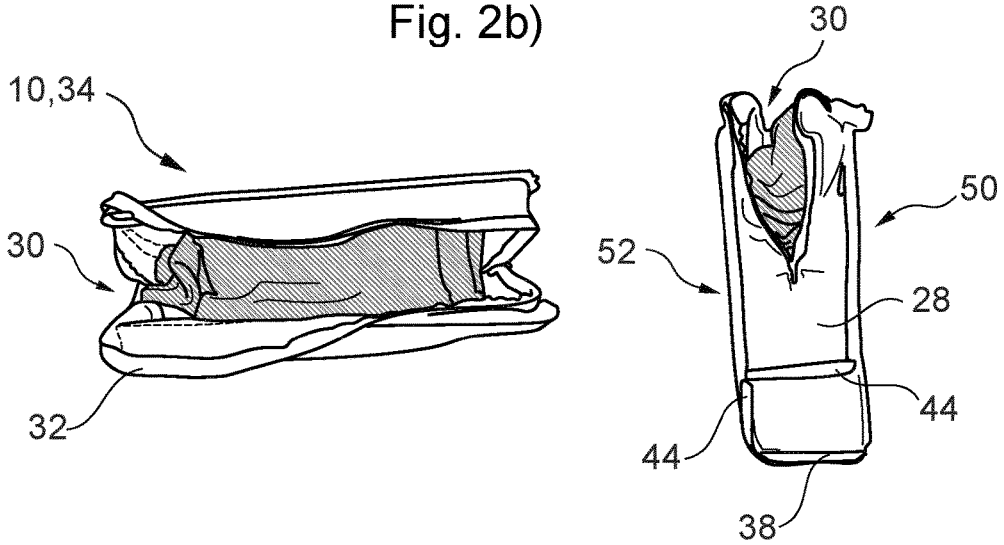
Figure 3A:
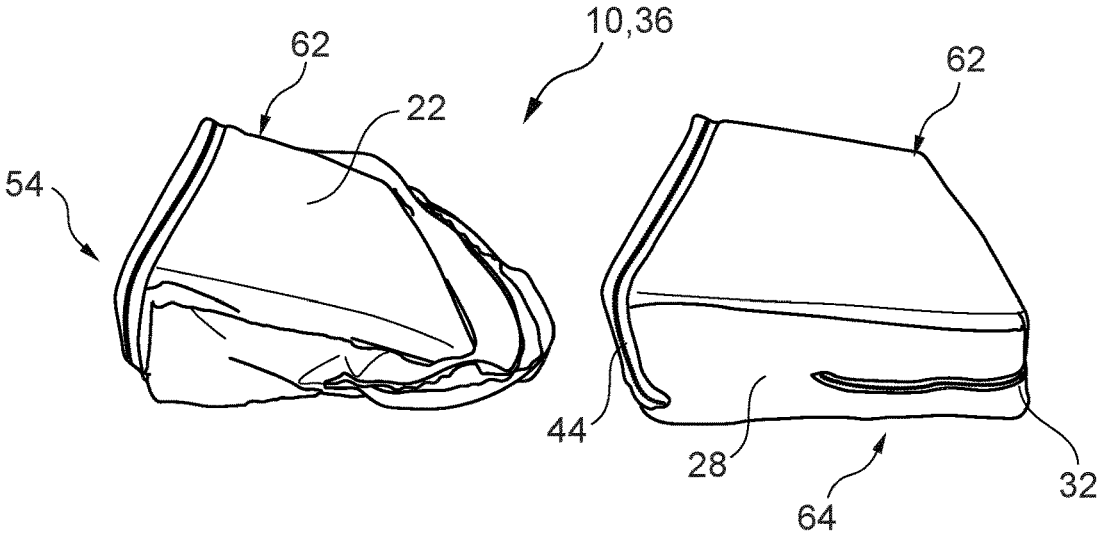
Figure 3B:
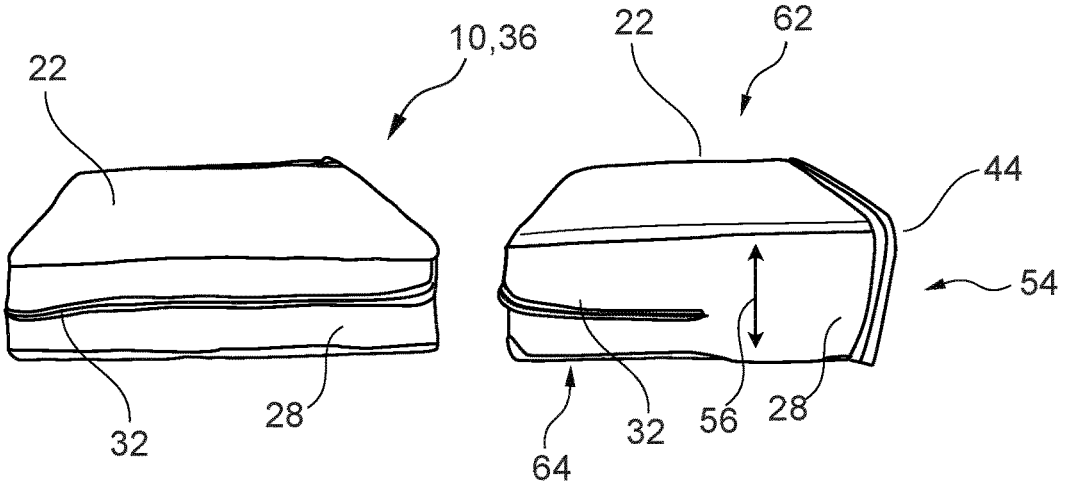
Figure 3C:
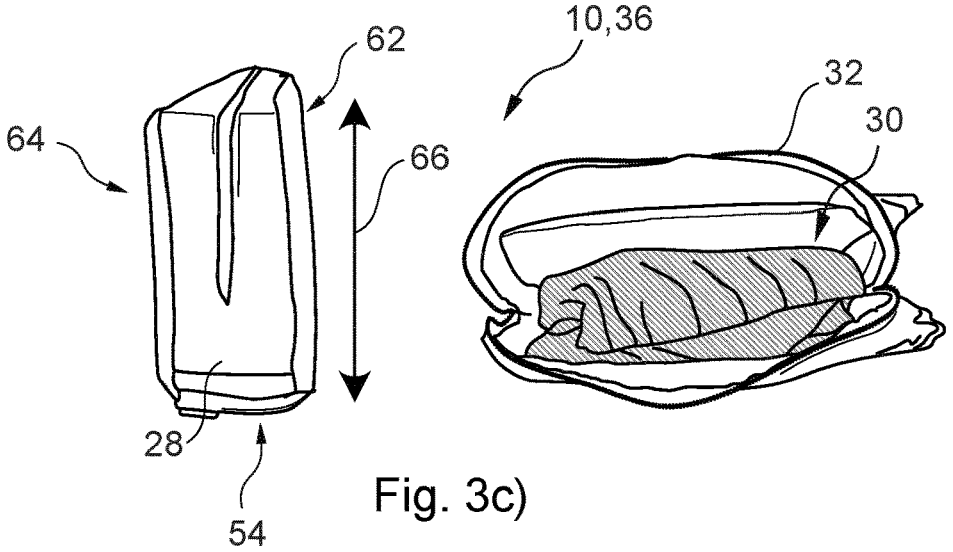
Figure 4:
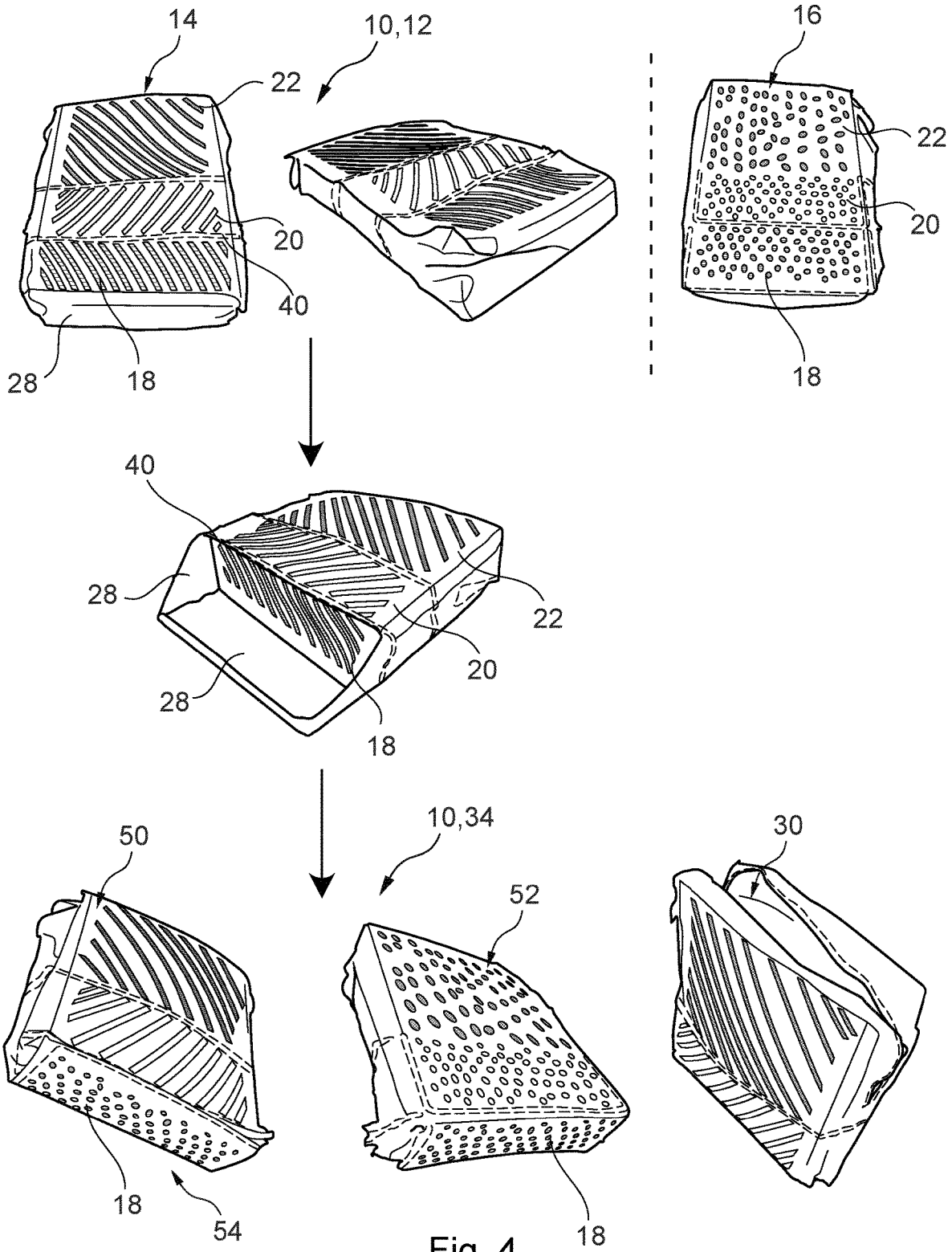
Figure 5:
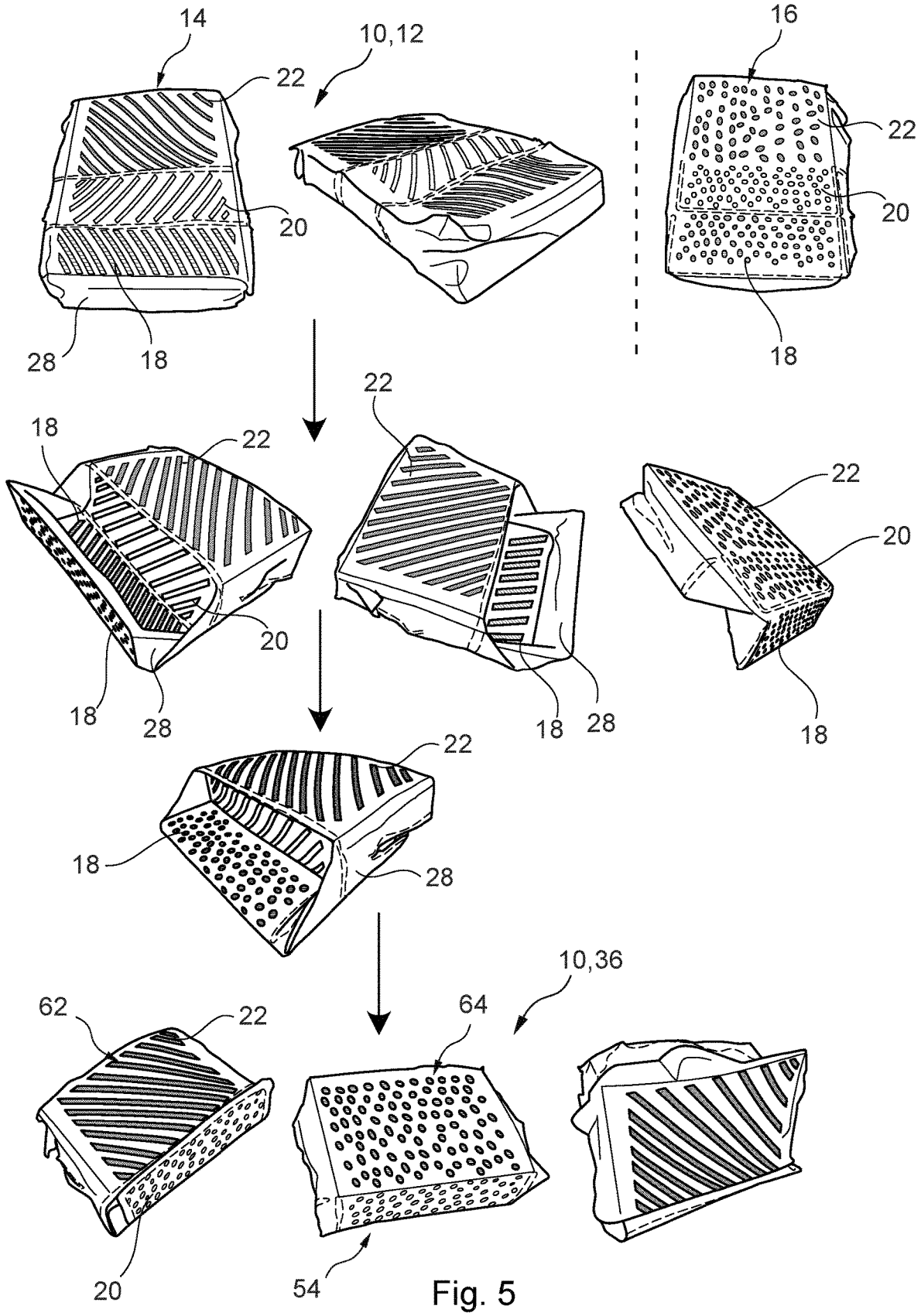

In the drawings:

FIG. 1 shows schematic illustrations of a packaging container in a shelf configuration from different perspectives, according to a preferred embodiment of the invention, FIG. 2 shows schematic illustrations of the packaging container of FIG. 1 in a first packaging configuration from different perspectives, FIG. 3 shows schematic illustrations of the packaging container of FIG. 1 in a second packaging configuration from different perspectives, FIG. 4 shows schematic illustration of a method for folding a packaging container from a shelf configuration into a first packaging configuration, according to a preferred embodiment of the invention, and FIG. 5 shows schematic illustration of a method for folding a packaging container from a shelf configuration into a second packaging configuration, according to a preferred embodiment of the invention.

DETAILED DESCRIPTION OF THE EMBODIMENTS

FIG. 1 shows a schematic illustration of a preferred embodiment of a packaging container 10 in a shelf configuration 12 from different perspectives. The packaging container 10 in the shelf configuration 12 is collapsible such that two opposite faces 14, 16 of the packaging container 10, 12 come in direct contact with each other. In the collapsed state, as shown in FIG. 1*b*) the packaging container 10, 12 is flat.

As is shown in FIG. 1*a*), which shows the two opposite faces 14, 16 of the packaging container 10 in the shelf configuration 12, each of the two opposite faces 14, 16 of the packaging container 10 in the shelf configuration 12 comprises a dimensionally stable first outer face part 18, a dimensionally stable middle face part 20, and a dimensionally stable second outer face part 22. The three face parts 18, 20, 22 are joint to each other by flexible joints 24, 26.

As is also visible in FIG. 1, the two opposite faces 14, 16 are circumferentially attached to each other by a flexible sidewall 28. The flexible sidewall 28 allows that the packaging container 10 is collapsible in the shelf configuration 12. FIG. 1*c*) shows the packaging container 10 in the shelf configuration 12, with goods packaged inside the packaging container 10. Thus, the two opposite faces 14, 16 are spaced apart and the flexible sidewall 28 is stretched. As is also visible in FIG. 1 the flexible sidewall 28 of the packaging container 10 comprises an opening 30 with a reusable closure 32, in order to fill the packaging container with the goods. In this embodiment the reusable closure 32 is a zipper 32.

In this preferred embodiment of the invention, the two opposite faces 14, 16 as well as the three face parts 18, 20, 22 have a rectangular form. Furthermore, the first outer face part 18 and the middle face part 20 are congruent to each other. Also, the form of the joint first outer face part 18 and middle face part 20 is congruent to the form of the second outer face part 22.

Furthermore, in this preferred embodiment, the first face 14, the second face 16, and the flexible sidewall 28 of the packaging container 10 are made of a soft piece of material. The first face 14 and the second face 16 are each enforced by three cardboard panels, forming the three face parts 18, 20, 22, while the soft material in between the three face parts 18, 20, 22 forms the flexible joints 24, 26. The cardboard panels for the first outer face part 18 and the middle face part 20 are 9.5 cm×32 cm, while the cardboard panel for the second outer face part 22 is 20 cm×32 cm. In order that the packaging container 10 can be folded along the flexible joints 24, 26, the width of the cardboard panels for the first outer face part 18 and the middle face part 20 is about 0.5 cm smaller than half of the width of the cardboard panel for the second outer face part 22. Thus, the form of the first outer face part 18 and the middle face part 20 joint together by the flexible joint 24 is congruent to the form of the second outer face part 22.

The packaging container 10 is configured for conversion from the shelf configuration 12 into a first packaging configuration 34 (see FIG. 2) by a first folding method (see FIG. 4), and from the shelf configuration 12 into a second packaging configuration 36 (see FIG. 3) by a second folding method (see FIG. 5). In the first and second packaging configuration 34, 36, the packaging container 10 is not collapsible and has a cuboidal shape.

In order to fasten the packaging container 10 in the first packaging configuration 34 the packaging container 10 comprises a first fastening device 38. In this preferred embodiment, the first fastening device 38 is a zipper 38, configured to fasten the packaging container 10 in the first packaging configuration 34. The zipper 38 is attached to the packaging container 10, such that a common edge 40 of the first outer face part 18 and the middle face part 20 of the first face 14 is fastened to an outer edge 42 of the first outer face part 18 of the second face 16.

In order to fasten the packaging container 10 in the second packaging configuration 36 the packaging container 10 comprises a second fastening device 44. In this preferred embodiment, the first fastening device 44 is a zipper 44, configured to fasten the packaging container 10 in the second packaging configuration 36. The zipper 44 is attached to the packaging container 10 such that a common edge 46 of the middle face part 20 and the second outer face part 22 of the first face 14 is fastened to a common edge 48 of the first outer face part 18 and the middle face part 20 of the second face 16.

When folding the packaging container 10 from the shelf configuration 12 into the first packaging configuration 34 and/or into the second packaging configuration 36, the face parts 18, 20, 22 are folded along the flexible joints 24, 26, which act as folding edges. Afterwards, the fastening devices 38, 44 are closed.

When folding the packaging container 10 form the shelf configuration 12 into the first packaging configuration 34 the common edge 40 of the first outer face part 18 and the middle face part 20 of the first face 14, i.e. the flexible joint 24 which also acts as folding edge along which the first outer face part 18 and/or middle face part 20 can be folded, is fastened to the outer edge 42 of the first outer face part 18 of the second face 16.

Furthermore, when folding the packaging container 10 form the shelf configuration 12 into the second packaging configuration 36, the common edge 46 of the middle face part 18 and the second outer face part 20 of the first face 14, i.e. the flexible joint 26 which also acts as folding edge along which the middle face part 20 and/or the second outer face part 22 can be folded, is fastened to the common edge 48 of the first outer face part 18 and the middle face part 20—i.e. the flexible joint 24 which also acts as folding edge along which the first outer face part 18 and/or the middle face part 20 can be folded—of the second face 16.

FIG. 2 shows schematic illustrations of the packaging container 10 of FIG. 1 in the first packaging configuration 34 from different perspectives. In the first packaging configuration 34 the packaging container 10 is configured such that two opposite faces 50, 52 of the packaging container 10 are attached to each other by a dimensionally stable sidepiece 54. The dimensionally stable sidepiece 54 is formed by the first outer face parts 18 of the packaging container 10 in the shelf configuration 12. The two opposite faces 50, 52 are each formed by the middle face part 20 and second outer face part 22 of the packaging container 10 in the shelf configuration 12. FIG. 2*a*) shows the packaging container 10 in the first packaging configuration 34 in an empty state lying on the first face 50, and in a state filled with goods. FIGS. 2*b*) and 2*c*) show the packaging container 10 in the first packaging configuration 34, when the packaging container 10 stands on the sidepiece 54. In this situation the opening 30 is on the top of the packaging container 10. As is best seen in FIG. 2*a*) a width 56 of the flexible sidewall corresponds to a width 58 of the first outer face part 18 and/or a width 60 of the middle face part 20.

FIG. 3 shows schematic illustrations of the packaging container 10 of FIG. 1 in the second packaging configuration 36 from different perspectives. In the second packaging configuration 36 the packaging container 10 is configured such that two opposite faces 62, 64 of the packaging container 10 are attached to each other by the dimensionally stable sidepiece 54. The dimensionally stable sidepiece 54 is formed by the first outer face parts 18 and the middle face parts 20 of the packaging container 10 in the shelf configuration 12. The two opposite faces 62, 64 are each formed by the second outer face part 22 of the packaging container 10 in the shelf configuration 12. Thus, the volume enclosed by the packaging container 10 in the second packaging configuration 36 is lower than the volume enclosed by the packaging container 10 in the first packaging configuration 34. FIG. 3*a*) shows the empty packaging container 10 in the second packaging configuration 36 lying on the face 64, on the left with an open reusable closure 32 and on the right with a closed reusable closure 32. FIG. 3*b*) shows the packaging container 10 in the second packaging configuration 36, when filled with goods, while FIG. 3*c*) shows the packaging container 10 in the second packaging configuration 36, standing on the dimensionally stable sidepiece 54.

When comparing FIGS. 2*b*) and 3*c*) it is clear that the packaging container 10 in the first packaging configuration 34 only differs from the packaging container 10 in the second packaging configuration 36 by an extent along one dimension—in FIGS. 2*b*) and 3*c*) the height 66 of the packaging container 10. The extent along the other two dimensions are the same.

FIG. 4 illustrates the folding method for folding the packaging container 10 from the shelf configuration 12 into the first packaging configuration 34, according to a preferred embodiment of the invention.

In the first step of the method, the packaging container 10 in the shelf configuration 12 is provided, such that the first face 14 of packaging container 10 in shelf configuration 12 is upwards, and forms the upper face 14. The upper face 14 of the packaging container 10 is marked with stripes. For comparison FIG. 4 also shows the lower face 16 of the packaging container 10, which is marked with dots.

Next, the dimensionally stable sidepiece 54 is formed. This is achieved by folding the first outer face part 18 of the upper face 14 towards the lower face 16. When folding the first outer face part 18 of the upper face 14 downwards along the common edge 40 of the first outer face part 18 and the middle face part 20, the flexible sidewall 28 is folded over the first outer face part 18 of the lower face 16.

Afterwards the first outer face part 18 of the lower face 16 is folded over the folded first outer face part 18 of the upper face 14, such that the first outer face part 18 of the upper face 14 and the first outer face part 18 of the lower face 16 coincide. When folding the first outer face part 18 of the lower face 16 upwards over the downwards folded first outer face part 18 of the upper face 14, the first outer face part 18 of the upper face 14, the inwards folded flexible sidewall 28 and the first outer face part 18 of the lower face 16 coincide.

In the last step of the method the first fastening device 38 is closed.

FIG. 5 illustrates the folding method for folding the packaging container 10 from the shelf configuration 12 into the second packaging configuration 36, according to a preferred embodiment of the invention.

In the first step of the method, the packaging container 10 in the shelf configuration 12 is provided, such that the first face 14 of packaging container 10 in shelf configuration 12 is upwards, and forms the upper face 14. The upper face 14 of the packaging container 10 is marked with stripes. For comparison FIG. 5 also shows the lower face 16 of the packaging container 10, which is marked with dots.

Next, the dimensionally stable sidepiece 54 is formed. This is achieved by bringing the first outer face part 18 of the upper face 14 into direct contact with the middle face part 20 of the lower face 16 such that the outer face part 18 and the middle face part 20 coincide. As can be seen in FIG. 5 this step also involves folding the middle face part 20 of the upper face 14 downwards and the first outer face part 18 of the lower face 16 upwards. When bringing the first outer face part 18 of the upper face 14 into direct contact with the middle face part 20 of the lower face 16 such that the outer face part 18 and the middle face part 20 coincide, the flexible sidewall 28 is folded over the first outer face part 18 of the lower face 16.

In a next step the first outer face part 18 of the lower face 16 is folded over the first outer face part 18 of the upper face 14, such that the first outer face part 18 of the lower face 16 coincides with the first outer face part 18 of the upper face 14. This folding leads to the situation that the inward folded flexible sidewall 28 is in between the first outer face part 18 of the upper face 14 and the downwards folded first outer face part 18 of the lower face 16.

In a next step the first outer face part 18 of the lower face 16, the first outer face part 18 of the upper face 14, and the middle face part 20 of the lower face 16 are together folded towards the middle face part 20 of the upper face 14. In this step also the inward folded flexible sidewall 28 in between the first outer face part 18 of the upper face 14 is folded towards the middle face part 20 of the upper face 14.

In the last step of the method the second fastening device 44 is closed.

LIST OF REFERENCE SIGNS

Packaging container 10
Shelf configuration of packaging container 12
First face of packaging container in shelf configuration, upper face 14
Second face of packaging container in shelf configuration, lower face 16
First outer face part 18
Middle face part 20
Second outer face part 22
Joint between first outer face part and middle face part 24
Joint between middle face part and second outer face part 26
Flexible sidewall 28
Opening 30
Reusable closure, zipper 32
First packaging configuration 34
Second packaging configuration 36
First fastening device, zipper 38
Common edge of first outer face part and middle face part of first face 40
Outer edge of first outer face part of second face 42
Second fastening device, zipper 44
Common edge of middle face part and second outer face part of first face 46
Common edge of first outer face part and middle face part of second face 48
First face of packaging container in first packaging configuration 50
Second face of packaging container in first packaging configuration 52
Dimensionally stable sidepiece 54
Width of sidewall 56
Width of first outer face part 58
Width of middle face part 60
First face of packaging container in second packaging configuration 62
Second face of packaging container in second packaging configuration 64
Height 66

The invention claimed is:

1. Packaging container for shipping goods, wherein the packaging container is configured for conversion from a shelf configuration into a first packaging configuration by a first folding method, and from the shelf configuration into a second packaging configuration by a second folding method, wherein in the shelf configuration the packaging container is collapsible such that two opposite faces of the packaging container in the shelf configuration come in direct contact with each other, wherein in the first and second packaging configuration the packaging container is configured such that two opposite faces of the packaging container in the first or second packaging configuration are attached to each other by a dimensionally stable sidepiece, wherein a volume enclosed by the packaging container in the first packaging configuration is different from a volume enclosed by the packaging container in the second packaging configuration, and wherein in the first packaging configuration the dimensionally stable sidepiece is formed by first outer face parts of the two opposite faces of the packaging container in the shelf configuration and wherein in the second packaging configuration the dimensionally stable sidepiece is formed by the first outer face parts and middle face parts of the two opposite faces of the packaging container in the shelf configuration, wherein each of the two opposite faces of the packaging container in the shelf configuration comprises the dimensionally stable first outer face part, the dimensionally stable middle face part, and a dimensionally stable second outer face part, joined to each other by flexible joints, and wherein a first fastening device is at least configured to fasten a common edge of the first outer face part and the middle face part of a first face of the two opposite faces to an outer edge of the first outer face part of a second face of the two opposite faces, and/or wherein a second fastening device is at least configured to fasten a common edge of the middle face part and the second outer face part of the first face of the two opposite faces to a common edge of the first outer face part and the middle face part of the second face of the two opposite faces.

2. Packaging container according to claim 1, wherein the packaging container is configured such that in the first packaging configuration and in the second packaging configuration an extent of the packaging container only differs along one dimension.

3. Packaging container according to claim 1, wherein in the packaging container is configured such that in the first and/or second packaging configuration the packaging container has essentially a cuboidal shape.

4. Packaging container according to claim 1, wherein in the shelf configuration the two opposite faces are circumferentially attached to each other by a flexible sidewall, and/or wherein in the first packaging configuration and/or in the second packaging configuration the two opposite faces are at least in part attached to each other by the flexible sidewall.

5. Packaging container according to claim 1, wherein a form of the first outer face part and a form of the middle face part are congruent to each other and/or a form of the first outer face part and a form of the middle face part are such that a joint form of the first outer face part and the middle face part attached to each other by a flexible joint is congruent to a form of the second outer face part and/or a width of a flexible sidewall corresponds to a width of the first outer face part and/or the middle face part.

6. Packaging container according to claim 1, wherein the packaging container in the first and/or second packaging configuration is waterproof and/or splash water protected, and/or wherein the packaging container is reusable and/or wherein the packaging container comprises an opening with a reusable closure.

7. Packaging container according to claim 1, wherein the first fastening device and/or the second fastening device is a zipper, a magnetic fastening device, a hook-and-eye closure, a hook-and-loop fastener, and/or a snap fastener.

8. Packaging container according to claim 1, wherein in the first packaging configuration one of the two opposite faces of the packaging container is free of the first and second fastening devices within an area of the one face of the packaging container, and/or wherein in the second packaging configuration both the opposite faces of the packaging container are free of the first and second fastening devices within an area of the faces of the packaging container.

9. Folding method for folding the packaging container from the shelf configuration into the first packaging configuration, wherein the packaging container is configured according to claim 1, comprising the steps of:

providing the packaging container in the shelf configuration, wherein in the shelf configuration the packaging container is collapsed such that a lower face and an upper face of the two opposite faces of the packaging container in the shelf configuration come in direct contact with each other, and wherein the lower and the upper faces each comprise the dimensionally stable first outer face part, the dimensionally stable middle face part, and the dimensionally stable second outer face part, joined to each other by the flexible joints, forming the dimensionally stable sidepiece by folding the first outer face part of the upper face towards the lower face, and folding the first outer face part of the lower face over the folded first outer face part of the upper face, such that the first outer face part of the upper face and the first outer face part of the lower face coincide, such that the dimensionally stable sidepiece of the packaging container in the first packaging configuration is formed by the first outer face parts of the two opposite faces of the packaging container in the shelf configuration.

10. Folding method for folding the packaging container from the shelf configuration into the second packaging configuration, wherein the packaging container is configured according to claim 1, comprising the steps of:

providing the packaging container in the shelf configuration, wherein in the shelf configuration the packaging container is collapsed such that a lower face and an upper face of the two opposite faces of the packaging container in the shelf configuration come in direct contact with each other, and wherein the lower and the upper faces each comprise the dimensionally stable first outer face part, the dimensionally stable middle face part, and the dimensionally stable second outer face part, joined to each other by the flexible joints, forming the dimensionally stable sidepiece by bringing the first outer face part of the upper face into direct contact with the middle face part of the lower face such that the outer face part and the middle face part coincide, and folding the first outer face part of the lower face over the first outer face part of the upper face, such that the first outer face part of the lower face coincides with the first outer face part of the upper face, and folding the first outer face part of the lower face, the first outer face part of the upper face, and the middle face part of the lower face together towards the middle face part of the upper face, such that the dimensionally stable sidepiece of the packaging container in the second packaging configuration is formed by the first outer face parts and the middle face parts of the two opposite faces of the pack-aging container in the shelf configuration.

* * * * *